United States Patent [19]

Hickman

[11] Patent Number: 4,586,301

[45] Date of Patent: May 6, 1986

[54] RETAINER CLAMP MEMBRANE FASTENING SYSTEM

[75] Inventor: John B. Hickman, Asheville, N.C.

[73] Assignee: W. P. Hickman Company, Asheville, N.C.

[21] Appl. No.: 638,342

[22] Filed: Aug. 6, 1984

[51] Int. Cl.[4] ..... E04D 5/14

[52] U.S. Cl. ..... 52/96

[58] Field of Search ..... 52/96, 410, 94, 273, 52/63, 461, 462, 463; 160/382, 383, 392, 395

[56] References Cited

U.S. PATENT DOCUMENTS

| | | | |
|---|---|---|---|
| 3,529,653 | 9/1970 | Fey | 160/383 |
| 4,037,372 | 7/1977 | Patry | 52/96 |
| 4,132,390 | 1/1979 | Pfarr | 160/392 |
| 4,231,141 | 11/1980 | Derrick et al. | 160/395 |

OTHER PUBLICATIONS

Brochure "The Snap-On Roof is Here!" published by Carlisle SynTec Systems.

*Primary Examiner*—Lenard A. Footland

*Attorney, Agent, or Firm*—Harness, Dickey & Pierce

[57] ABSTRACT

A retainer clamp membrane fastening system is disclosed particularly adapted for retaining elastomeric membrane materials in position on a building roof. Various embodiments are described which may be attached to an upwardly projecting wall around the roof or which may be mounted directly to the roof perimeter. Each of the retainer clamp assemblies includes a core member which is fastened to the roof or wall surface. The core member has a pair of outwardly projecting arm portions. The membrane material is placed over the core member and a retainer clip is clipped over the membrane. The retainer clip includes leg sections having converging and diverging sections. The converging section conforms with the shape of a portion of the core member arms; the diverging sections engage with teeth of a clamping piece which fits over the entire assembly. The retainer clamp assembly according to this invention is inexpensive, attractive and reliable in preventing wind and water leakage of the roof.

14 Claims, 5 Drawing Figures

RETAINER CLAMP MEMBRANE FASTENING SYSTEM

BACKGROUND AND SUMMARY OF THE INVENTION

This invention relates to a membrane fastening system and particularly, to such a system adapted for use in supporting single-ply roofing material to a building structure.

Many structures, such as industrial buildings, schools, office buildings, etc. have substantially flat roofs which must be water and weather proofed. One method for providing such protection employs a single-ply elastomeric membrane covering the entire roof surface. A means for fastening such roofing material to the building structure is necessary. It is desirable for such a fastening system to be aesthetically pleasing, low in cost, and wind and water tight. The retainer system should further be easy to install and protect the single-ply roofing material from perforations or damage.

The above desirable features for a roofing material fastening system are provided in accordance with this invention. The membrane fastening system according to this invention employs an elongated core member which is first secured to the building structure. Thereafter, the elastomeric membrane is placed over the core member and an elongated retainer clip is installed which pinches against the core member, thereby securing the edges of the membrane in place. Finally, one or more clamping pieces are snapped into position over the retainer clip which increases the clamping force exerted on the core member thereby firmly clamping the roofing membrane in place. Each of the above fastening system components are elongated and have a uniform cross-sectional shape. These components are preferably arranged around the entire perimeter of a roof which is covered by a membrane.

The fastening system according to this invention is low in cost, attractive in appearance, easy to install, and contains a number of design features which provide reliable water and weather proofing. In a first embodiment, a retainer clamp fastening system is described which is particularly adapted to be attached to an upstanding wall or to a parapet at the edge of a roof. A second embodiment of the invention describes a retainer clamp fastening system particularly adapted to be mounted to the outer perimeter edge of a roof which includes a decorative clamping fascia piece and is further adapted to retain a paver or paving blocks against the roof surface. A third embodiment of the invention describes another retainer clamp which is useful for attachment at the outer perimeter edge of a roof. A fourth embodiment is described employing a modified core component and which is also particularly adapted for placement at the outer perimeter edge of a roof.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE INVENTION

Figures 1, 2:
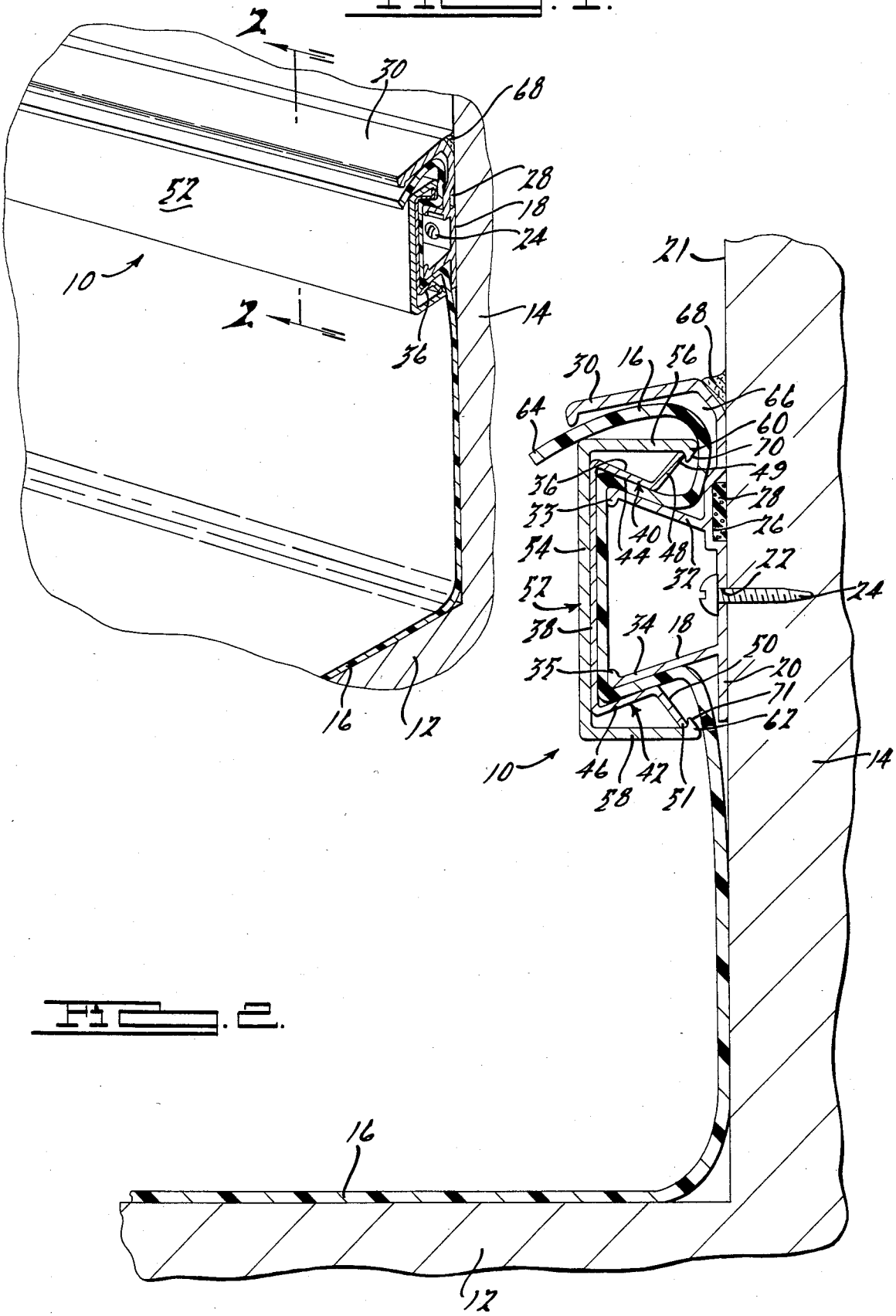
FIG. 1 is a pictorial view of a retainer clamp assembly according to a first embodiment of this invention particularly adapted for attachment to a vertical wall surface.
FIG. 2 is a cross-sectional view of the first embodiment of a retainer clamp assembly shown by FIG. 1.

A retainer clamp assembly according to a first embodiment of this invention is shown by FIGS. 1 and 2 and is generally designated there by reference character 10. Retainer clamp assembly 10 is particularly adapted for use where the roof 12 perimeter terminates in an upstanding wall 14. Wall 14 can be another part of the building, or can be provided to insure the retention of roofing materials such as gravel which may be placed upon roof 12 and also provide a fascia for aesthetic considerations. For this application, an elastomeric membrane 16 is spread on the roof surface and partially upward along wall 14. Retainer clamp assembly 10 is elongated and retains the membrane perimeter in position around the edge of the roof 12.

The various components of roof clamp assembly 10 are shown with reference to FIGS. 1 and 2. Core member 18 includes a base portion 20 having one or more openings or slots 22 which enable core member 18 to be secured to wall 14 by any type of conventional fastener such as screw 24. Numerous other types of fastening systems, including adhesives, could, however, be employed. Base portion 20 forms groove 26 which receives sponge gasket 28 which acts to prevent water seepage between base portion 20 and the inside surface 21 of wall 14. Base portion 20 further includes flange 30 which extends away from the surface of wall 14 and acts to prevent direct rain water contact with the other components of retainer clamp assembly 10, as will be subsequently described in detail.

Core member 18 further includes a pair of projecting arms 32 and 34, which preferably have rounded terminal edges 33 and 35, respectively. Projecting arms 32 and 34 also preferably diverge as the distance from base portion 20 increases, as shown by FIG. 2. In order to provide additional stability of core member 18, base portion 20 could be extended downwardly along the surface of wall 14. Additionally, such an extended base portion could feature openings or slots for additional fasteners.

Retainer clamp assembly 10 further includes retainer clip 36 having center section 38 and a pair of extending legs 40 and 42. Each of legs 40 and 42 include converging sections 44 and 46 which terminate with diverging sections 48 and 50. Converging sections 44 and 46 are configured to cooperate with arms 32 and 34 of core member 18 to clamp membrane 16 against the core member.

Retainer clamp assembly 10 further includes clamping piece 52 having a center section 54 and a pair of separated wall portions 56 and 58. Wall portions 56 and 58 have an inwardly directed hook or tang 60 and 62 formed at their terminal edges. As shown by FIG. 2, edges 60 and 62 engage the terminal edges 49 and 51 of diverging sections 48 and 50, respectively, of retainer clip 36.

Core member 18, retainer clip 36 and clamping piece 52 may be made from any number of materials including numerous types of plastics and metals. Since each of these components are elongated and have a uniform cross-sectional shape, manufacturing processes such as extrusion or pultrusion are particularly suitable. Also, the core member, retainer clip and clamping piece have arm and leg members which are sufficiently flexible to allow deflection of the components when they are assembled.

Preferably, clamping piece 52 comprises an elongated section on the order of 8–10 feet in length and is positioned over elongated sections of the core members and retainer clips of similar lengths. It is also possible, however, to provide clamping piece 52 in smaller lengths particularly where it is out of sight (e.g. FIGS. 1 and 2) and does not form part of a decorative fascia configuration (e.g. FIGS. 3–5).

In use, core member 18 is first secured against wall 14. Next, flexible membrane 16 is placed over arms 32 and 34 of core member 18. Retainer clip 36 is then installed over membrane 16, thus retaining the membrane against core member 18. Retainer clip 36 installs easily over core member 18 since diverging sections 48 and 50 of the retainer clip act as ramps causing deflection of portions of the retainer clip and the core member. Finally, clamping piece 52 is snapped into position over retainer clip 36 such that hook edges 60 and 62 engage the edges 49 and 51 of the retainer clip. This engagement firmly and securely locks retainer clip 36 onto core member 18.

Where it is necessary to use a number of lengths of the retainer clamp assembly, a number of core members 18 are fastened end-to-end in a line or around a perimeter at the desired location. Then, after the elastomeric member is positioned in place, the retainer clips 16 are secured in place covering all or substantially all of the length of the core members 18. Thereafter, the clamping pieces 52, whether in long sections or discrete pieces are locked in place.

The excess material 64 of membrane 16 protrudes from cavity 66 formed between flange 30 and wall portion 56 of clamping piece 52. The membrane material 16 can be trimmed so that its edge is flush with clamping piece center section 54. Flange 30 is preferably sloped to form a small roof surface covering the remainder of retainer clamp assembly 10 and also preferably extends outwardly beyond the clamping piece 52. This roof feature prevents direct water contact with retainer clamp assembly 10 and thereby provides enhanced water leakage protection. The joint between base core member 18 and wall 14 is preferably caulked along fillet 68. This caulking acts in conjunction with sponge gasket 28 to prevent water seepage between retainer clamp assembly 10 and the surface 21 of wall 14.

In order to provide protection against perforation of membrane 16, the terminal edges 33 and 35 of arms 32 and 34, respectively, are preferably rounded. Similarly, the extending edges of clamping piece wall portions 56 and 58 are also rounded. To provide ease of installation, the edges of wall portions 56 and 58 are further formed to have sloping leading edges 70 and 71 which act as ramps in guiding the parts during installation.

Figure 3:
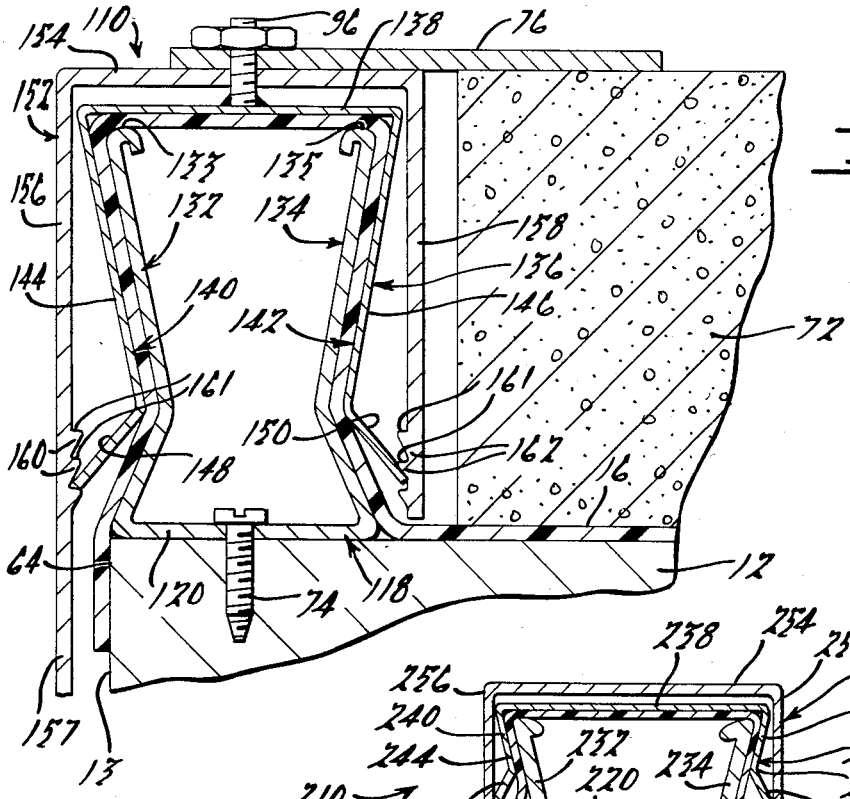
FIG. 3 is a cross-sectional view of a second embodiment of a retainer clamp assembly according to this invention which is particularly adapted for installation at an outer perimeter edge of a roof and which further includes a system for retaining paving blocks against the roof top surface.

A second embodiment according to this invention is shown by FIG. 3. Retainer clamp assembly 110 is particularly adapted for applications where the building roof 12 does not terminate with an upstanding perimeter wall 14 but instead is flat to the side wall surface 13 of the building. The embodiment shown by FIG. 3 further is most advantageously used where paving blocks 72 are placed on top of membrane 16. Retainer clamp assembly 110 includes core member 118 having a base portion 120 which is secured against roof 12 by a fastener. As shown by FIG. 3, base portion 120 is secured using conventional screws 74 or other appropriate fasteners. Core member 118 further includes a pair of extending arms 132 and 134. As with the first embodiment, these arms preferably have rounded or smooth terminal edges 133 and 135 to prevent damage to membrane 16. Arms 132 and 134 further include portions which are diverging.

Once membrane 16 is installed over core member 118, retainer clip 136 is installed. Retainer clip 136 includes a center section 138 and a pair of leg sections 140 and 142, each of the leg sections having intermediate converging sections 144 and 146 which terminate in diverging sections 148 and 150.

Clamping piece 152 includes a center section 154 and wall portions 156 and 158. These wall portions also have one or more inwardly directed teeth 160 forming edges 161. A plurality of such edges are provided for each of the wall portions to enable clamping piece 152 to be locked into engagement with retainer clip 136 at various extents of engagement between the two parts. Wall portion 156 is elongated with respect to 158 such that it has a portion 157 thereon which extends below the plane of roof 12. This elongated wall portion 157 provides a means for obscuring the remaining components of retainer clamp assembly 110, as well as the terminal end 64 of membrane 16, thereby acting as a fascia to enhance the aesthetic appearance of the building roof edge.

Attached to center section 154 of clamping piece 152, or made integral therewith, is plate 76 which extends toward the center of roof 12 and acts to retain paving blocks 72 against the top of roof 12, thereby preventing the paving blocks from being displaced or blown off the roof by wind. For the embodiment shown by FIG. 3, plate 76 is connected to clamping piece 152 by threaded fastener 96 which is welded to clip 136. Of course, other fastening means could be used to connect the plate 76 to the clip 136 or to the clamping piece 152. In order to accommodate the thickness of paving block 72, the components of retainer clip assembly 110, including base portion 120, retainer clip 136 and clamping piece 152, should be made with a sufficient axial height to properly position plate 76 with respect to the top surface of paving block 72. Also, of course, plate 76 could be bent upwardly or downwardly to accommodate paving blocks 72 of different thicknesses. As with the first described embodiment, each of the components of clamp assembly 110 can be made of numerous materials such as formed sheet metal or plastic materials.

Figure 4:
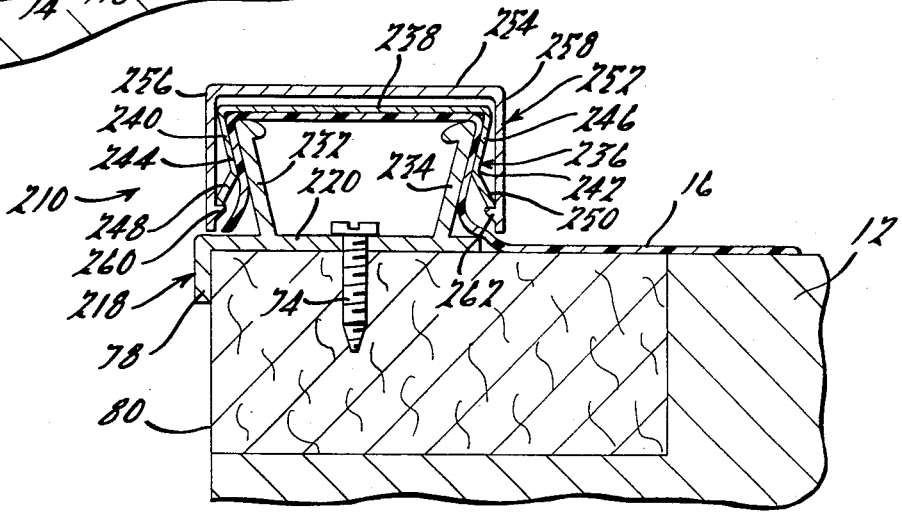
FIG. 4 is a retainer clamp assembly according to a third embodiment of this invention showing a retainer clamp assembly particularly adapted for installation around a roof perimeter edge.

A third embodiment of a retainer clamping assembly 210 according to this invention is shown with reference to FIG. 4. Like the embodiment shown by FIG. 3, retainer clamp asembly 210 is particularly adapted to be installed around the perimeter edge of roof 12 in instances where the roof does not include an upstanding wall 14. Retainer clamp assembly 210 includes a core member 218, a retainer clip 236 and a clamping piece 252. The core member 218 has a base portion 220 secured by screws 74 (or other appropriate fasteners) to roof 14 and a pair of diverging arms 232 and 234. Core member 218 varies from those embodiments previously described in that its base portion 220 is extended to form a downwardly projecting flange 78 which is placed against side 80 of the building. Flange 78 performs the function of elongated wall portion 157 of the embodiment shown in FIG. 3 in that it encloses the joint between the retainer clamp assembly and roof 12 and enhances the aesthetic appearance of the assembly when installed.

Once core member 218 is fastened in place and membrane 16 is placed over it, retainer clip 236 is installed. Retainer clip 236 is substantially the same as retainer clip 36, described above with respect to FIGS. 1 and 2, and has a center section 238, and a pair of legs 240 and 242. The legs 240 and 242 each have converging sections 244 and 246, and diverging sections 248 and 250, respectively.

Clamping piece 252 is similar to clamping piece 52 (FIGS. 1 and 2) having a center section 254 and a pair of separated wall portions 256 and 258. The engagement of clamping piece 252 with retainer clip 236 is achieved by providing teeth 260 and 262 which engages the ends of diverging sections 248 and 250 of the retainer clip.

Figure 5:
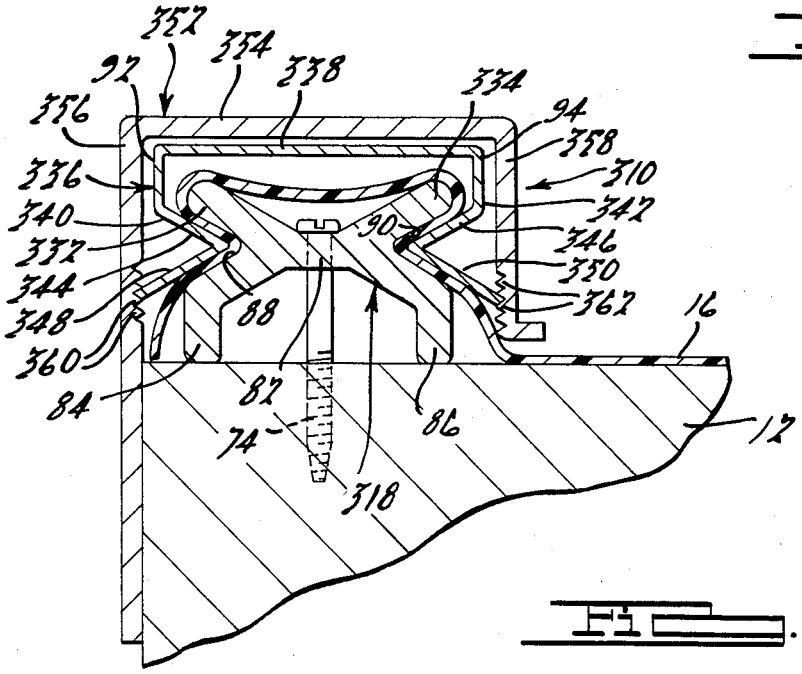
FIG. 5 is a retainer clamp assembly having a modified core member and retainer clip according to a fourth embodiment of this invention which is also particularly adapted for mounting at an outer peripheral edge of a roof.

A fourth embodiment according to this invention is shown in FIG. 5. Retainer clamp assembly 310 is particularly adapted, like the second and third described embodiments, for attachment at the outer perimeter edge of roof 12. This embodiment varies from those previously described principally in shape of core member 318 as compared to the previously described core members. Core member 318 has a modified "X" shape in cross section having a pair of arms 332 and 334 which meet at a center web section 82. Core member 318 further includes a pair of downwardly projecting base legs 84 and 86. Fastening of core member 318 to roof 12 is achieved in any conventional manner such as by screws 74 or other appropriate fasteners. In the side surface of core member 318, near the intersection between arms 332 and 334, and base legs 84 and 86, are inwardly directed grooves 88 and 90.

Like the previous embodiments, membrane 16 is placed around the exterior surface of core member 318 and held in place by retainer clip 336. Retainer clip 336 of this embodiment includes center section 338 and a pair of separated legs 340 and 342, each having converging sections 344 and 346, and diverging sections 348 and 350, respectively. This embodiment of a retainer clip 336, however, differs from those previously disclosed in that wall portions 92 and 94 which extend from the center section 338 at approximately a 90° angle therefrom and separate converging sections 344 and 346 from center section 338.

The clamping assembly 310 further includes a clamping piece 352. Clamping piece 352, like clamping piece 152 described above, includes a center section 354, and two wall portions 356 and 358. In addition, one wall portion 356 is longer than its corresponding other wall portion 358 and provides the aesthetic advantages described in connection with the previous embodiments.

In order to secure the clamping piece in place and to allow some flexibility for differently sized membranes and roof edge structures, a plurality of teeth or grooves 360 and 362 are provided on clamping piece 352. The teeth or grooves 360 and 362 are adapted to mate with and firmly hold in place the ends of the diverging sections 348 and 350 of the retainer clip 336.

While the above description constitutes the preferred embodiments of the present invention, it will be appreciated that the invention is susceptible to modification, variation and change without departing from the proper scope and fair meaning of the accompanying claims.

What is claimed is:

1. A retainer clamp assembly for attaching a flexible membrane to a surface without puncturing said membrane comprising:

an elongated core member having a pair of extending arms, means for attaching said core member to said surface, an elongated retainer clip having a center section and a pair of separated legs, each of which terminate along a clip edge, said retainer clip conformed to fit over said core member with said membrane therebetween, and at least one clamping piece having a center section and a pair of separated wall portions, said clamping piece conformed to fit over and enclose said retainer clip, said clamping piece wall portions engageable with said retainer clip edges whereby said retainer clip and said clamping piece are held together in an assembled condition and cooperate to clamp said membrane against said core member.

2. A retainer clamp assembly for attaching a flexible membrane to a building comprising:

an elongated core member having a base portion and a pair of arms which diverge as they extend from said base portion, means for attaching said core member to said building, an elongated retainer clip having a center section and a pair of separated legs, said separated legs each having a converging section and a diverging section, said converging section conformed to cooperate with said core member diverging sections to retain said retainer clip in position over said core member with said membrane therebetween, and at least one clamping piece having a center section and a pair of separated wall portions, said clamping piece conformed to fit over and enclose said retainer clip, said wall portions forming edges with which the terminal edges of said retainer clip diverging sections engage whereby said retainer clip and said clamping piece cooperate to clamp said membrane against said core member.

3. A retainer clamp assembly according to claim 2 wherein the terminal edges of said core member arms are rounded to prevent perforations of said membrane.

4. A retainer clamp assembly according to claim 2 wherein said edge of said clamping piece side wall portions are formed by at least one inwardly directed tooth.

5. A retainer clamp assembly according to claim 2 wherein said edge of said clamping piece side wall portions are formed by more than one inwardly directed tooth.

6. A retainer clamp assembly according to claim 2 wherein said retainer clamp assembly is particularly adapted to be mounted to a vertically extending wall surface, said retainer clamp assembly further comprising:

said core member having an extending roof portion connected to said base portion.

7. A retainer clamp assembly according to claim 6 wherein said core member base portion has an elongated groove for placement of gasket means and thereby to inhibit water leakage between said core member and said vertically extending wall surface.

8. A retainer clamp assembly according to claim 2 wherein one of said clamping piece wall portions is extended to extend along the side surface of said building when said clamping piece is attached to said retainer clip.

9. A retainer clamp assembly according to claim 2 wherein said core member further includes a flange which extends along the side surface of said building when said core member is attached to said building roof.

10. A retainer clamp assembly according to claim 2 further comprising:

a cover plate extending from said clamping piece in a direction generally parallel with the surface of said roof when said cover plate is installed on said retainer clip, said cover plate acting to retain a paver block in contact with said roof.

11. A retainer clamp assembly according to claim 2 wherein said core member further includes a pair of downwardly projecting base legs, said base legs and said core member arms cooperating to form elongated channels within the side surfaces of said core member.

12. A retainer clamp assembly according to claim 11 wherein said retainer clip further includes a pair of spaced parallel wall portions.

13. A retainer clamp assembly according to claim 2 wherein at least two clamping pieces are provided to clamp said member along the length of each retainer clip and core member.

14. A retainer clamp assembly for attaching a flexible membrane to a building comprising:

an elongated core member having a base portion and a pair of opposed surfaces, each of said surfaces having sections which diverge as they extend from said base portion, means for attaching said core member to said building, an elongated retainer clip having a center section and a pair of separated legs, each of which terminates along a clip edge, said separated legs each having a diverging section, said legs conformed to cooperate with said core member diverging sections to retain said retainer clip in position over said core member with said membrane therebetween, and at least one clamping piece having a center section and a pair of separated wall portions, said clamping piece conformed to fit over and enclose said retainer clip, said wall portions engaging said clip edges whereby said retainer clip and said clamping piece cooperate to clamp said membrane against said core member.

* * * * *